US011426890B2

(12) United States Patent
Han et al.

(10) Patent No.: US 11,426,890 B2
(45) Date of Patent: Aug. 30, 2022

(54) RAZOR CARTRIDGE AND RAZOR ASSEMBLY USING THE SAME

(71) Applicant: DORCO CO., LTD., Seoul (KR)

(72) Inventors: Da Woon Han, Seoul (KR); Jong Jin Jeong, Seoul (KR); Dong Il Kim, Seoul (KR)

(73) Assignee: DORCO CO., LTD., Seoul (KR)

( * ) Notice: Subject to any disclaimer, the term of this patent is extended or adjusted under 35 U.S.C. 154(b) by 7 days.

(21) Appl. No.: 16/987,290

(22) Filed: Aug. 6, 2020

(65) Prior Publication Data

US 2021/0069923 A1 Mar. 11, 2021

(30) Foreign Application Priority Data

Sep. 11, 2019 (KR) ..... 10-2019-0112685

(51) Int. Cl.
*B26B 21/44* (2006.01)
*B26B 21/22* (2006.01)
*B26B 21/40* (2006.01)

(52) U.S. Cl.
CPC ..... *B26B 21/446* (2013.01); *B26B 21/225* (2013.01); *B26B 21/4018* (2013.01); *B26B 21/4025* (2013.01); *B26B 21/4037* (2013.01)

(58) Field of Classification Search
None
See application file for complete search history.

(56) References Cited

U.S. PATENT DOCUMENTS 4,077,119 A 3/1978 Sellera
4,809,432 A 3/1989 Schauble
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
(Continued)

FOREIGN PATENT DOCUMENTS

EP 1152872 12/2002
EP 2338652 4/2015
(Continued)

OTHER PUBLICATIONS

European Patent Office Application Serial No. 20191304.3, Search Report dated Jan. 26, 2021, 9 pages.

*Primary Examiner* — Hwei-Siu C Payer

(74) *Attorney, Agent, or Firm* — Lee, Hong, Degerman, Kang & Waimey PC

(57) ABSTRACT

At least one embodiment of the present disclosure provides a razor assembly including at least one shaving blade having a cutting edge, a blade housing, and an aid supplying member. The blade housing is configured to accommodate at least one shaving blade such that a width direction of the blade housing is in parallel with a longitudinal direction of the cutting edge and includes an inlet portion, a discharge portion, and a communication portion configured to communicate the inlet portion to the discharge portion. The aid supplying member is configured to deliver a shaving aid to the inlet portion. The shaving aid that is delivered from the aid supplying member is introduced into the inlet portion, passes through the communication portion, and is discharged from the discharge portion.

11 Claims, 7 Drawing Sheets

(56) References Cited

U.S. PATENT DOCUMENTS

| | | | |
|---|---|---|---|
| 6,052,903 | A | 4/2000 | Metcalf et al. |
| 6,185,822 | B1 | 2/2001 | Tseng et al. |
| 6,212,777 | B1 | 4/2001 | Gilder et al. |
| 6,442,839 | B1 | 9/2002 | Tseng et al. |
| 6,516,518 | B1 | 2/2003 | Garraway et al. |
| 6,612,040 | B2 | 9/2003 | Gilder |
| 6,684,513 | B1 | 2/2004 | Clipstone et al. |
| 6,789,321 | B2 | 9/2004 | Simms |
| 7,121,754 | B2 | 10/2006 | Bressler et al. |
| 8,438,735 | B2 | 5/2013 | De Klerk |
| 8,745,877 | B2 | 6/2014 | Szczepanowski et al. |
| 8,826,543 | B2 | 9/2014 | Szczepanowski et al. |
| 9,321,182 | B2 | 4/2016 | Bridges et al. |
| 9,375,856 | B2 | 6/2016 | Bennik et al. |
| 9,381,657 | B2 | 7/2016 | Xu et al. |
| 2005/0123342 | A1 | 6/2005 | Bressler et al. |
| 2005/0144786 | A1 | 7/2005 | Bressler et al. |
| 2010/0236071 | A1* | 9/2010 | Szczepanowski .. B26B 21/4018 30/41.5 |
| 2011/0146080 | A1* | 6/2011 | Pauw ..... B26B 21/446 30/41.5 |
| 2013/0145625 | A1 | 6/2013 | Xu et al. |
| 2013/0326881 | A1* | 12/2013 | Blatter ..... B26B 21/446 30/41 |
| 2021/0069922 | A1* | 3/2021 | Han ..... B26B 21/225 |
| 2021/0069923 | A1* | 3/2021 | Han ..... B26B 21/4012 |

FOREIGN PATENT DOCUMENTS

| | | |
|---|---|---|
| JP | 2004321322 | 11/2004 |
| WO | 2015066391 | 7/2015 |

* cited by examiner

RAZOR CARTRIDGE AND RAZOR ASSEMBLY USING THE SAME

CROSS-REFERENCE TO RELATED APPLICATIONS

Pursuant to 35 U.S.C. § 119(a), this application claims the benefit of earlier filing date and right of priority to Korean Patent Application Number 10-2019-0112685, filed on Sep. 11, 2019, the contents of which are hereby incorporated by reference herein in its entirety.

TECHNICAL FIELD

The present disclosure in some embodiments relates to a razor cartridge and a razor assembly using the same.

BACKGROUND

The statements in this section merely provide background information related to the present disclosure and do not necessarily constitute prior art.

In using a wet razor, several factors can cause discomfort to the user.

For example, the friction force generated between the blade housing and the skin, the cutting force applied to the hair during cutting, irritation to a wounded skin area, etc., may cause inconvenience to the user.

To reduce such discomfort, shaving aids such as shaving foam, shaving gel, and shaving cream are used.

Shaving aids include a lubricating component and can be applied to the user's skin, which can reduce irritation applied to the skin during shaving.

A recently available razor is adapted to store a shaving aid in a razor handle and discharge the stored shaving aid from the razor cartridge thereof (hereinafter called fluid spray razors).

U.S. Pat. No. 6,789,321 (hereinafter referred to as Patent Document 1), which is one of the conventional fluid spray razors, is adapted to deliver a shaving aid to a razor cartridge by using a conduit provided in the razor handle and to discharge the shaving aid from the razor cartridge.

However, Patent Document 1 has an issue of inseparability between regions of the razor cartridge, involving a region for letting in the shaving aid delivered (hereinafter, the inflow region) from the conduit (hereinafter, the fluid supply conduit) of the razor handle and another region for discharging the shaving aid (hereinafter, the discharge region) from the razor cartridge. Specifically, the inseparable inflow and discharge regions may place many restrictions on the design of a razor.

For example, the position of the fluid supply conduit and the position of the inflow region may be limited to where the discharge region can be disposed, and, conversely, the position of the discharge area may be limited by the position of the fluid supply conduit and the position of the inflow region.

In addition, the position of the fluid inflow region and the position of the discharge region may be determined under conditions that the fluid supply conduit does not interfere with the razor cartridge when pivoting the same.

Therefore, to solve the above-described deficiencies, there is an actual need for a new and original type of fluid spray razor with little design constraints.

SUMMARY

According to at least one embodiment, the present disclosure provides a razor assembly including at least one shaving blade having a cutting edge, a blade housing, and an aid supplying member. The blade housing is configured to accommodate at least one shaving blade such that a width direction of the blade housing is in parallel with a longitudinal direction of the cutting edge and includes an inlet portion, a discharge portion, and a communication portion configured to communicate the inlet portion to the discharge portion. The aid supplying member is configured to deliver a shaving aid to the inlet portion. The shaving aid that is delivered from the aid supplying member is introduced into the inlet portion, passes through the communication portion, and is discharged from the discharge portion.

DETAILED DESCRIPTION

Figure 1:
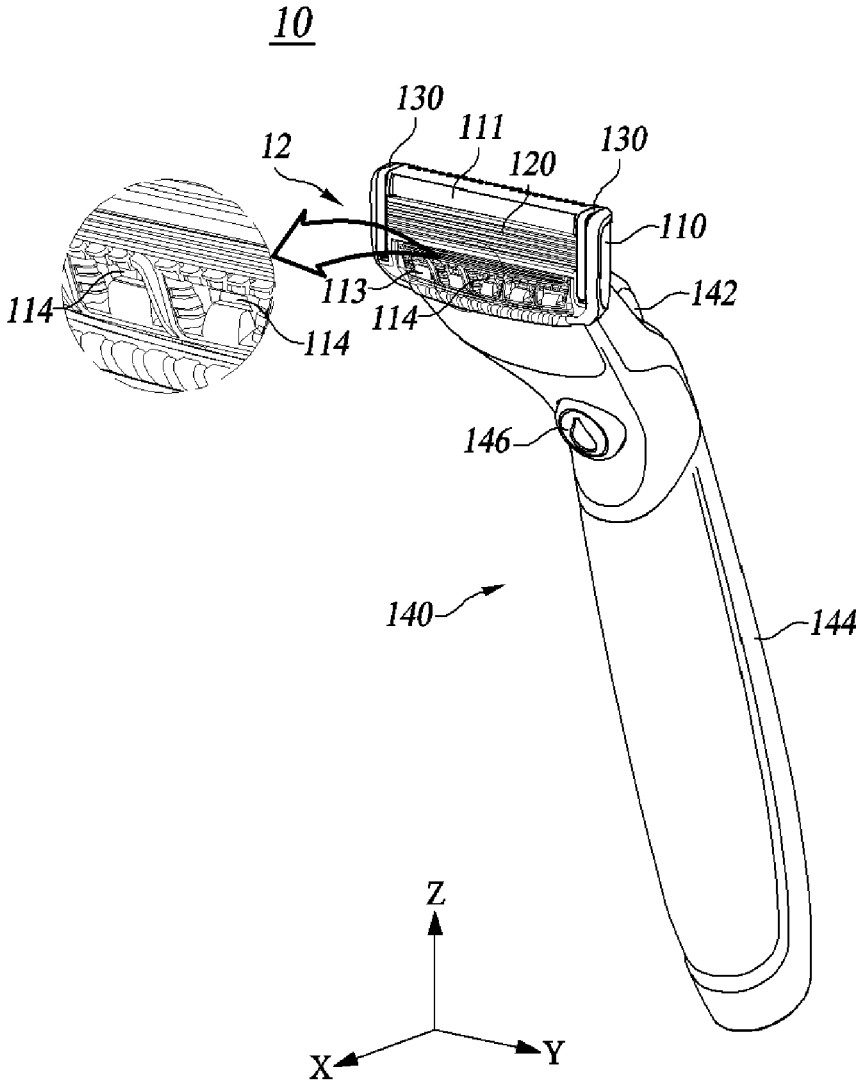
FIG. 1 is a perspective view of a razor assembly according to at least one embodiment of the present disclosure.

The present disclosure seeks to provide a razor assembly capable of isolating portions of a razor cartridge, separating between an inlet portion for letting in a shaving aid and a discharge portion for discharging the shaving aid.

Exemplary embodiments of the present disclosure are described below with reference to the accompanying drawings. In the following description, like reference numerals would rather designate like elements, although the elements are shown in different drawings. Further, in the following description of the at least one embodiment, a detailed description of known functions and configurations incorporated herein will be omitted for the purpose of clarity and for brevity.

Additionally, alphanumeric code such as first, second, i), ii), (a), (b), etc., in numbering components are used solely for the purpose of differentiating one component from the other but not to imply or suggest the substances, the order or sequence of the components. Throughout this specification, when a part "includes" or "comprises" a component, the part is meant to further include other components, not excluding thereof unless there is a particular description contrary thereto.

FIG. 1 is a perspective view of a razor assembly 10 according to at least one embodiment of the present disclosure.

As shown in FIG. 1, the razor assembly 10 may include a razor cartridge 12 and a razor handle 140.

The razor cartridge 12 may include a blade housing 110, at least one or more shaving blades 120 and at least one or more clips 130.

The blade housing 110 may accommodate the shaving blades 120 having cutting edges. Here, the longitudinal direction of the cutting edges corresponds to the length direction of the blade housing 110. For example, in FIG. 1, the longitudinal direction of the cutting edges is a direction parallel to the Y-axis.

Once accommodated on one side of the blade housing 110, the shaving blades 120 may be retained by a plurality of clips 130.

The blade housing 110 may include a cap 111, a guard 113, and at least one or more discharge portions 114.

The cap 111 may be located rearward of the shaving blades 120, and specifically, may be disposed forward of the blade housing 110, which the cutting edges point to.

Here, the forward and rearward directions of the shaving blade 120 are defined based on the shaving direction of the razor cartridge 12. Accordingly, in FIG. 1, the forward and rearward directions of the shaving blades 120 are the negative Z-axis direction and the positive Z-axis direction, respectively, with respect to the shaving blades 120.

The guard 113, on the front side of the blade housing 110, may be located in front of the shaving blades 120.

During shaving, the guard 113 may stretch the skin in the direction of shaving prior to cutting the hair by the shaving blades 120.

This can erect the user's hair in a direction perpendicular to the user's skin surface such that the shaving blades 120 can cut the hair more easily.

Figure 3:
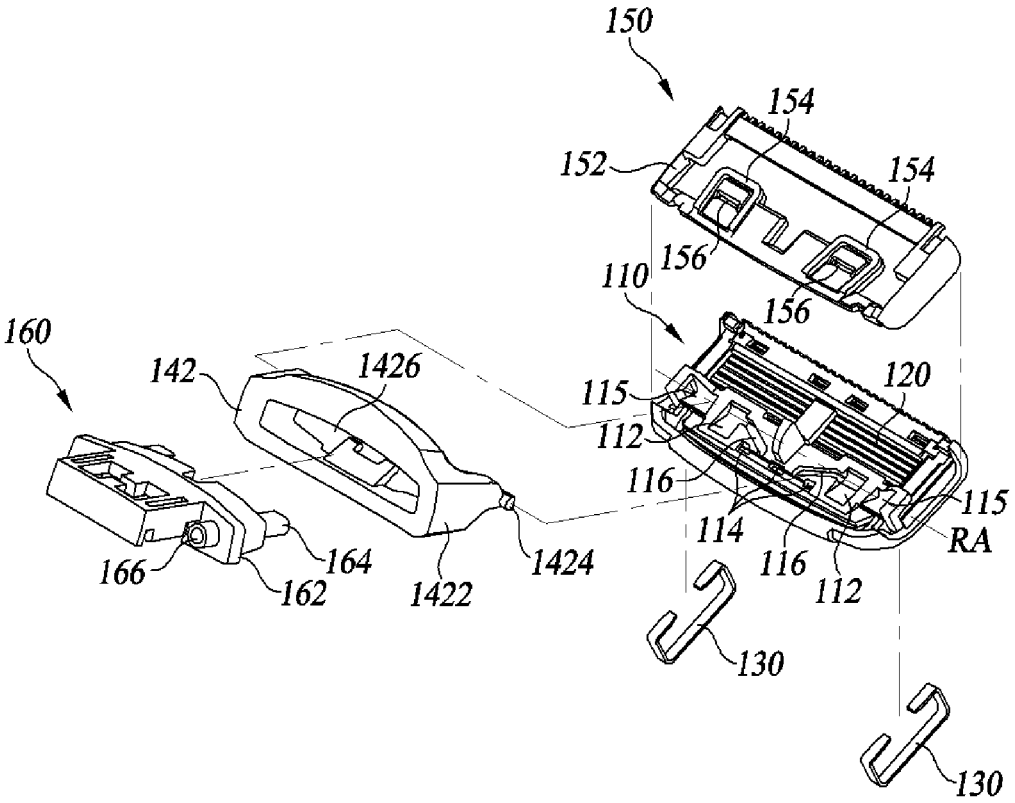
FIG. 3 is an exploded perspective view of a razor assembly according to at least one embodiment of the present disclosure.

The discharge portions 114 may be regions on the blade housing 110 through which a shaving aid is ejected or discharged after being delivered through at least one or more inlet portions 112 and communication portions 116 (both of FIG. 3).

Here, the shaving aid refers to various materials applied to the skin of a user to assist shaving. For example, the shaving aid may be one of, but not limited to, shaving foam, shaving gel, and shaving cream.

The shaving aid may be a fluid material, but may be other materials having fluidity. For example, the shaving aid may be a solid material in the form of a powder or a fluid material having a solid material.

During shaving, for allowing the shaving aid to be applied to the user's skin, each discharge portion 114 may include an opening formed in the front surface of the blade housing 110.

The discharge portion 114 may be disposed forward of at least one shaving blade 120. This enables the shaving aid to be applied to the user's skin during shaving, before cutting the hair by the shaving blade 120. However, the present disclosure is not limited to this configuration.

For example, the discharge portion 114 may overlap the area on the blade housing 110 in which the shaving blade 120 is disposed, or may be disposed rearward of the shaving blade 120.

The clips 130 may clip the shaving blade 120 to the blade housing 110, thereby preventing the shaving blade 120 from being detached from the blade housing 110.

The razor handle 140 may include a head portion 142, a grip portion 144, and a discharge operating member 146.

The blade housing 110 may be coupled, pivotally, with respect to the head portion 142, about a rotation axis (RA) parallel to the longitudinal direction of the cutting edge.

The grip portion 144 may extend from the head portion 142 and provide the user with an area for gripping the razor assembly 10.

The head portion 142 and the grip portion 144 may be formed as separate members from each other, but the present disclosure is not limited thereto. For example, the head portion 142 and the grip portion 144 may be integrally formed.

The discharge operating member 146 may discharge a shaving aid from an aid supplying member 160 (FIG. 3) through a discharge action.

The discharge operating member 146 may include a button portion and an actuator. When pressed by the user, slid by the user or otherwise moved, the button portion may activate the actuator connected to it. The actuator serves to transfer the shaving aid stored in an aid storage to the aid supplying member. The actuator may employ a mechanism capable of injecting a fluid, such as a diaphragm valve or the like.

The razor assembly 10 employing the diaphragm valve mechanism may include an aid storage (not shown), an aid receiving space (not shown), a first valve (not shown) disposed between the aid supplying member 160 and the aid receiving space, and a second valve (not shown) disposed between the aid receiving space and the aid storage.

In this case, one side of the aid receiving space may be made of an elastic tube (not shown), and the discharge operating member 146 may be disposed adjacent to the elastic tube. The discharge operating member 146 may depress the elastic tube to discharge the shaving aid from the aid supplying member.

Specifically, when pressing the discharge operating member to depress the elastic tube, the shaving aid in the aid receiving space may pressurize the first valve to open thereof. As a result, the shaving aid in the aid receiving space may be delivered to the aid supplying member 160 through the first valve before it is discharged. When the shaving aid in the aid receiving space is discharged to some extent, the degree of pressure on the first valve is reduced, and the first valve may be closed.

Thereafter, upon releasing the discharge operating member, the elastic tube may be restored to the original position by the elastic force, whereby the pressure inside the aid receiving space may be lowered. This will generate a flow of shaving aid to be urged from the high-pressure aid storage toward the low-pressure aid receiving space, and this flow may pressurize the second valve to open the same.

Through this arrangement, the shaving aid stored in the aid storage may be delivered to the aid receiving space. When more than a certain amount of shaving aid is delivered to the aid receiving space, the pressure difference decreases between the aid storage and the aid receiving space, so that the second valve may be closed.

The shaving aid delivered to the aid receiving space may be stored therein until the next pressing operation of the discharge operating member 146.

The shaving aid discharged from the aid supplying member 160, passing through the inlet portions 112 and the communication portions 116, may be emitted from the discharge portions 114.

The discharge operating member 146 may have a configuration in which the shaving aid is discharged by a predetermined amount through a single action for discharge. However, the present disclosure is not limited to this configuration. For example, the discharge operating member 146 may be configured to discharge the shaving aid continuously while the discharge action is maintained.

Figure 2:
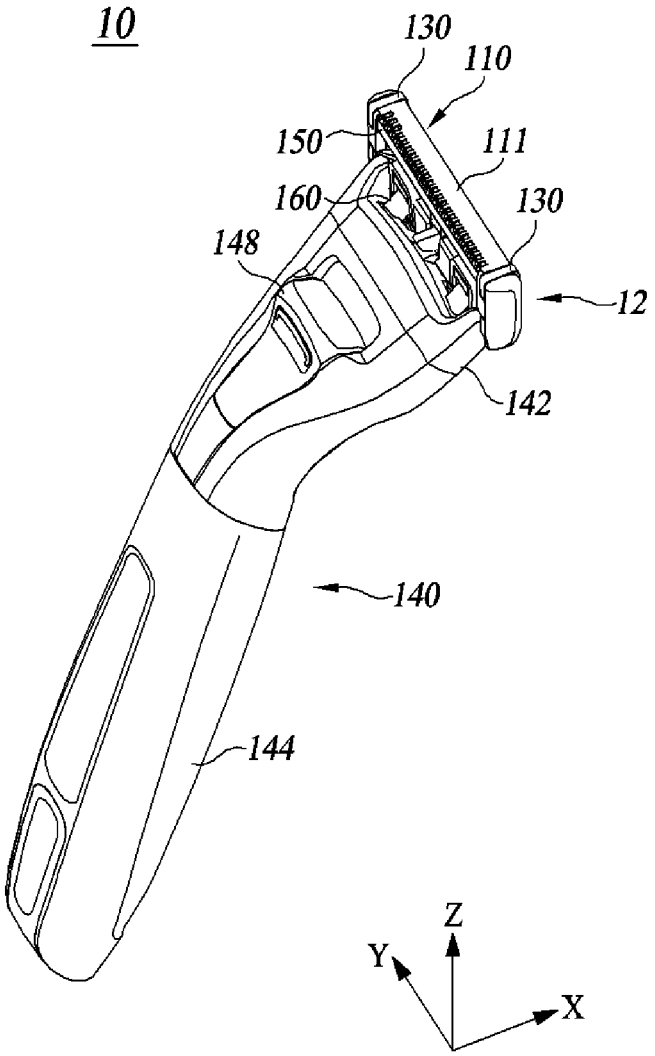
FIG. 2 is a rear perspective view of a razor assembly according to at least one embodiment of the present disclosure.

FIG. 2 is a rear perspective view of the razor assembly 10 according to at least one embodiment.

FIG. 3 is an exploded perspective view of the razor assembly 10 according to at least one embodiment.

As shown in FIGS. 2 and 3, the razor assembly 10 may include a cover member 150 and the aid supplying member 160.

The cover member 150 may cover at least a portion of the rear surface of the blade housing 110. Specifically, the cover member 150 may be detachably coupled to the rear surface of the blade housing 110.

After detaching the cover member 150 from the blade housing 110, the user can wash the rear surface of the blade housing 110. This process helps to wash or remove foreign matters accumulated in the inlet portions 112, the discharge portions 114, and the communicating portions 116.

By covering the communication portions 116 formed in the form of grooves on the rear surface of the blade housing 110, the cover member 150 may form a completed aid transfer passage. A detailed description in this regard will be provided in connection with FIG. 4.

Referring back to FIGS. 2 and 3, the cover member 150 may include a cover body 152, at least one or more receiving valves 154, and at least one or more receiving holes 156.

The cover body 152 may be detachably coupled to the rear surface of the blade housing 110.

The receiving valve 154 may prevent the shaving aid discharged out of the aid supplying member 160 at its discharge end 164 from backflowing and then leaking out of the razor cartridge 12 at an unintended position.

The receiving valve 154 may be disposed on the cover body 152 at a position corresponding to the inlet portion 112, the receiving hole 156 may be formed laterally of the receiving plate 154.

The discharge end 164 of the aid supplying member 160 inserted into the receiving hole 156 may be accommodated in a space between the receiving valve 154 and the inlet portion 112.

The receiving valve 154 and the receiving hole 156 may be made of an elastic material. This enables the discharge end 164 and the receiving hole 156 taking advantage of elastic deformation to maintain the receiving valve 154 and the receiving hole 156 in firm sealing engagement, even when the razor cartridge 12 pivots.

In this case, to improve the sealing performance, the area of the receiving hole 156 may be smaller than the cross-sectional area of the discharge end 164. The receiving hole 156 into which the discharge end 164 is inserted may have its area enlarged by elastic deformation, and accordingly, the outer circumferential surface of the discharge end 164 can be strongly pressed. However, the present disclosure is not limited to this configuration and the area of the receiving hole 156 may be equal to or larger than the area of the discharge end 164.

The receiving valve 154 and the receiving hole 156 may be made of, but not limited to, a rubber material.

The aid supplying member 160 may include a supplying member body 162, the discharge ends 164, and at least one or more inlet ends 166.

The supplying member body 162 may be accommodated in a receiving space 1426 that is formed in the head portion 142.

The discharge end 164 may extend from one side of the supplying member body 162.

The discharge end 164 may receive the shaving aid delivered from the inlet end 166 communicating with the discharge end 164 and discharge the shaving aid to the inlet portion 112.

The inlet end 166 may receive the shaving aid from the aid storage (not shown) of the razor handle 140 and may deliver the shaving aid to the discharge end 164.

The head portion 142 may include a head frame 1422, at least one or more bosses 1424, and the receiving space 1426.

Inside the head frame 1422, the receiving space 1426 is configured to accommodate the supplying member body 162.

The bosses 1424 may protrude laterally from the head frame 1422 and may be inserted into boss holes 115 formed on the blade housing 110.

The bosses 1424 are inserted into the boss holes 115 to define a rotation axis RA parallel to the longitudinal direction of the cutting edge. The razor cartridge 12 may pivot with respect to the head portion 142 around the rotation axis RA.

In FIGS. 2 and 3, the aid supplying member 160 is illustrated as being disposed on the razor handle 140, but the present disclosure is not limited to this configuration.

For example, the aid supplying member 160 may be disposed in any one of the razor cartridge 12 and a connector (not shown) that connects between the razor cartridge 12 and the razor handle 140.

When the aid supplying member 160 is disposed on the connector, coupling the connector in connection with the razor cartridge 12 further to the razor handle 140 allows an aid containing member (not shown) of the razor handle 140 to be in communicative contact with the aid supplying member 160 disposed on the connector. Thus, the shaving aid in the aid containing member may be delivered to the aid supplying member 160 and discharged.

In addition, FIGS. 2 and 3 illustrate that the head portion 142 and the aid supplying member 160 are made of separate members from each other, but the present disclosure is not limited thereto.

For example, the aid supplying member 160 may be integrally formed with any one of the connector (not shown), the razor cartridge 12, and the razor handle 140.

Still referring to FIGS. 2 and 3, the razor handle 140 may include a release or ejecting member 148.

The ejecting member 148 may release the razor cartridge 12 from the razor handle 140 through an action for ejection.

Here, the action for ejection may be, but not limited to, a pushing operation or a sliding operation.

The blade housing 110 may include the inlet portions 112 and the communication portions 116.

Each inlet portion 112 may be an area on the blade housing 110, into which the shaving aid discharged from the aid supplying member 160 is introduced.

The inlet portion 112 may be disposed on the back of the blade housing 110 for introduction of the shaving aid.

Each communication portion 116 is disposed between the inlet portion 112 and the discharge portion 114, and it can communicate between the inlet portion 112 and the discharge portion 114. In other words, the communication portion 116 may serve as a passage interconnecting the inlet portion 112 and the discharge portion 114.

The communication portion 116 may be configured to change in depth or width as it goes from the inlet portion 112 to the discharge portion 114.

For example, the communication portion 116 may be configured to decrease in depth or width as it goes from the inlet portion 112 to the discharge portion 114. In this case, on the communication portion 116, the surrounding area of the discharge portion 114 may have an increased flow rate relative to the surrounding region of the inlet portion 112, whereby the discharge portion 114 may generate more powerful outflows of the shaving aid.

Conversely, the communication portion 116 may be configured to have its depth or width increased from the inlet portion 112 toward the discharge portion 114. This can prevent an abrupt discharge of excessive amount of shaving aid from the discharge portions 114.

However, the present disclosure is not limited to these configurations, and the communication portion 116 may have substantially the same depth or width along its length.

Figure 4:
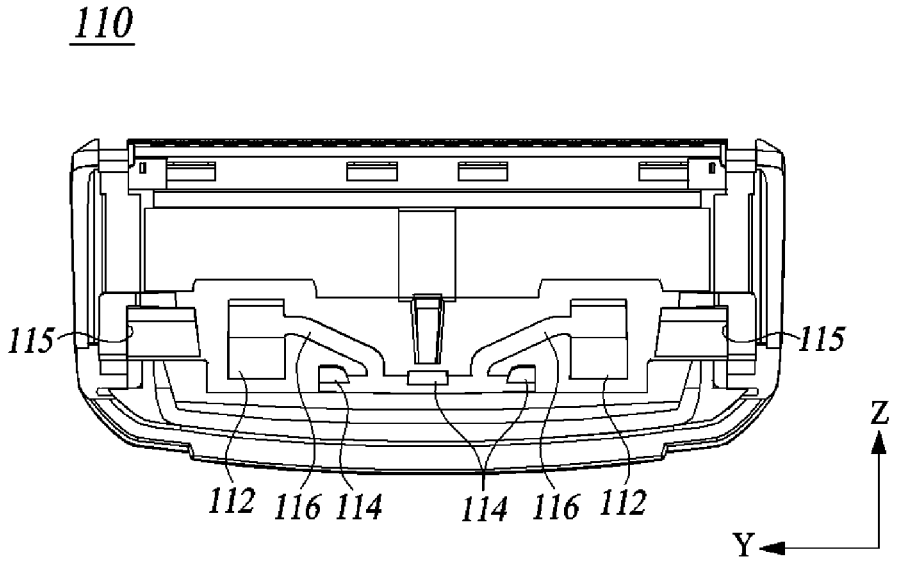
FIG. 4 is a rear view of a blade housing according to at least one embodiment of the present disclosure.

FIG. 4 is a rear view of the blade housing 110 according to at least one embodiment.

As shown in FIG. 4, the inlet portion 112, the discharge portion 114, and the communication portion 116 may collectively form an aid transfer passage connected as a whole.

Here, the aid transfer passage refers to a flow path through which the shaving aid delivered from the razor handle 140 can flow inside the razor cartridge 12.

The discharge portions 114 may be disposed spaced apart from the inlet portions 112 along the longitudinal direction of the cutting edge. Specifically, the discharge portions 114, on the blade housing 110, may be disposed laterally inside of the inlet portions 112. However, the present disclosure is not limited to this configuration.

For example, the discharge portions 114, on the blade housing 110, may be disposed laterally outside of the inlet portions 112.

The discharge portion 114 may be disposed spaced apart from the inlet portion 112 in the transverse direction, which is parallel to the shaving direction and is perpendicular to the longitudinal direction of the cutting edge. Specifically, the discharge portions 114, on the blade housing 110, may be disposed in the front of the inlet portions 112 in the transverse direction.

However, the present disclosure is not limited to this configuration. For example, the discharge portions 114 may be disposed on the blade housing 110 in the rear of the inlet portions 112 in the transverse direction.

Here, the transverse direction corresponds to the height direction of the blade housing 110. For example, in FIG. 4, the transverse direction is a direction parallel to the Z-axis. In addition, in FIG. 4, the front and rear in the transverse direction are the negative Z-axis direction and the positive Z-axis direction, respectively.

Each discharge portion 114 is spaced apart from the inlet portion 112 both transversely and longitudinally. In this case, the discharge portion 114 may be spaced diagonally from the inlet portion 112. However, the present disclosure is not limited to this configuration.

For example, the discharge portion 114 may be spaced apart only in the transverse direction or only in the longitudinal direction from the inlet portion 112.

Multiples of the inlet portion 112 and multiples of the discharge portion 114 may be provided on the blade housing 110. However, the present disclosure is not limited thereto, and a single inlet portion 112 or a single discharge portion 114 may be provided on the blade housing 110.

With the razor assembly 10 according to at least one embodiment of the present disclosure, one technical advantage of connecting the inlet portion 112 and the discharge portion 114 through the communication portion 116 includes providing design freedom for repositioning any number of the inlet portions 112 and the discharge portions 114 as appropriate.

Thus, the razor assembly 10 according to at least one embodiment of the present disclosure has fewer design constraints and, at the same time, has an effect of spraying or applying a shaving aid more effectively.

Meanwhile, the communication portion 116 may have a recessed shape on the rear surface of the blade housing 110. In other words, the communication portion 116 may have a shape of a groove formed along the aid transfer passage. In this case, the communication portion 116 may have one side opened on the blade housing 110.

The open side of the communication portion 116 may be closed by the cover member 150 disposed on the rear surface of the blade housing 110. This completely defines the aid transfer passage between the blade housing 110 and the cover member 150. In this case, the aid transfer passage may have all areas thereof closed except the area where the shaving aid is introduced and the area where the latter is discharged.

With the razor assembly 10 according to at least one embodiment of the present disclosure, one technical advantage includes providing the communication portion 116 in the form of a groove and closing an open side of the groove with the cover member 150 to form the aid transfer passage.

In general, the process of forming a groove on the surface of the blade housing 110 is easier compared to the process of forming a through path inside the blade housing 110. Therefore, the razor assembly 10 according to at least one embodiment of the present disclosure may use a simpler process for forming an aid transfer passage easily.

Alternatively, the communication portion 116 may be formed through the inside of the blade housing 110.

The discharge portion 114 may have a shape penetrating the blade housing 110 in the thickness direction. In this case, one opening of the discharge portion 114, which is formed on the rear surface of the blade housing 110, may be closed by the cover member 150.

Here, the thickness direction corresponds to a direction in which the thickness of the blade housing 110 is formed. For example, in FIG. 1, the thickness direction is a direction parallel to the X-axis.

The shaving aid delivered to the discharge portions 114 may be prevented from being discharged from the rear surface of the blade housing 110 by the cover member 150. This guides the shaving aid to be collected in the discharge portions 114.

When a predetermined amount of shaving aid is collected in the discharge portions 114, the shaving aid may be discharged through the other opening of the discharge portions 114, which is formed on the front surface of the blade housing 110.

Accordingly, the razor assembly 10 according to at least one embodiment of the present disclosure has a manufacturing advantage that can form the discharge portions 114 through a simple process of penetrating the blade housing 110.

Figure 5:
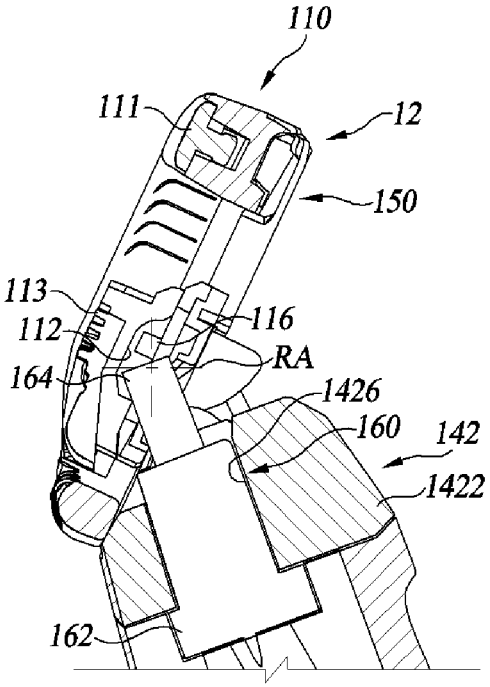
FIG. 5 is a side cross-sectional view of a razor assembly according to at least one embodiment of the present disclosure.

FIG. 5 is a side cross-sectional view of the razor assembly 10 according to at least one embodiment.

Figure 6:
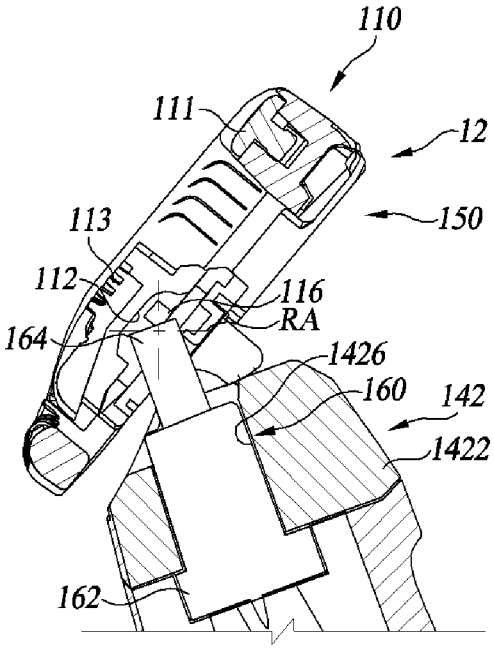
FIG. 6 is a side sectional view of the razor assembly of FIG. 5 having been pivoted.

FIG. 6 is a side cross-sectional view of the razor assembly 10 of FIG. 5 having been pivoted.

As shown in FIGS. 5 and 6, the blade housing 110 may pivot with respect to the head portion 142 around rotation axis RA parallel to the longitudinal direction. Rotation axis RA may be defined by inserting the bosses 1424 of the head portion 142 into the boss holes 115 of the blade housing 110.

The discharge ends 164 inserted into the receiving holes 156 may not interfere with the inlet portions 112 when the blade housing 110 rotates around the rotation axis RA.

Accordingly, the blade housing 110 can pivot freely with respect to the head portion 142.

Rotation axis RA may penetrate the discharge ends 164 when the blade housing 110 rotates around the rotation axis RA. This can minimize the space occupied by the discharge end 164 when the blade housing 110 is rotated, thereby minimizing the interference of the discharge ends 164 with the inlet portions 112.

Alternatively, rotation axis RA may be configured to be positioned adjacent to the discharge ends 164 or to penetrate the inlet portions 112 without passing through the discharge ends 164.

The second to sixth embodiments of the present disclosure shown in FIGS. 7 to 11 to be described below are different from the at least one embodiment as illustrated in FIGS. 1 to 6 in terms of the position and the number of the inlet portions and the discharge portions. The following will concentrate on the distinctive features according to the respective embodiments of the present disclosure, and repeated descriptions of the same components as the at least one embodiment will be omitted.

Figure 7:
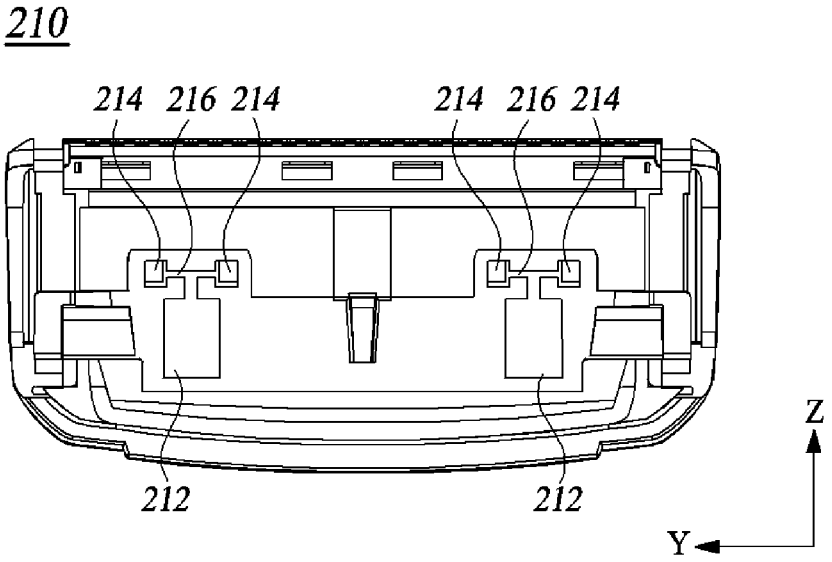
FIG. 7 is a rear view of a blade housing according to a second embodiment of the present disclosure.

FIG. 7 is a rear view of a blade housing 210 according to a second embodiment of the present disclosure.

FIG. 7 shows discharge portions 214 which may overlap an area of the blade housing 210 in which at least one shaving blade is disposed. In this case, the shaving aid discharged from the discharge portions 214 may be discharged from the back of the shaving blade to the front thereof.

The razor assembly according to the second embodiment of the present disclosure is configured to discharge the shaving aid to an area where the shaving blade is disposed so that the hair may be cut by the shaving blade while the shaving aid is applied to the user's skin. This results in minimized damage to the skin due to shaving.

Figure 8:
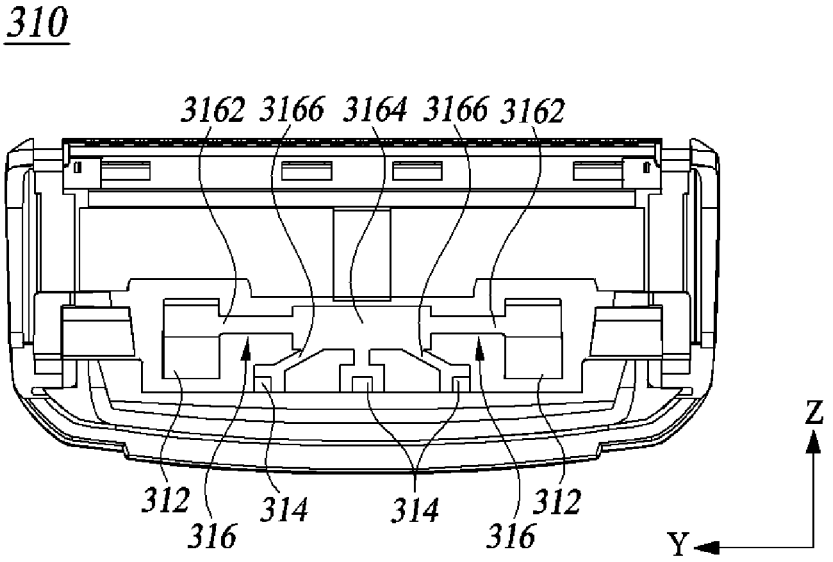
FIG. 8 is a rear view of a blade housing according to a third embodiment of the present disclosure.

FIG. 8 is a rear view of a blade housing 310 according to a third embodiment of the present disclosure.

FIG. 8 shows communication portions 316 each including a converging portion 3162, a divergence point 3164, and a plurality of diverging portions 3166.

The converging portions 3162 may communicate at least one of inlet portions 312 formed on the blade housing 310 to the divergence point 3164, and the plurality of diverging portions 3166 may communicate with a plurality of discharge portions 314 formed on the blade housing 310, respectively.

The converging portions 3162 may receive the shaving aid from at least one inlet portion 312 and deliver the shaving aid to the divergence point 3164.

The shaving aid delivered to the divergence point 3164 may temporarily stay therein and the shaving aid may be further delivered after passing through the diverging portions 3166 to the respective discharge portions 314.

The razor assembly according to the third embodiment of the present disclosure is configured to converge the shaving aid from one or more inlet portions 312 and deliver the converged shaving aid to the plurality of discharge portions 314, thereby providing an aid transfer passage with a more simplified shape.

In addition, the razor assembly according to the third embodiment of the present disclosure has an effect of maintaining the function of discharging the shaving aid even if a part of the aid delivery passage is blocked by foreign material or the like.

For example, when a plurality of the inlet portions 312 and the converging portions 3162 are provided, even if one of the plurality of converging portions 3162 is blocked due to the accumulation of foreign materials or the like, the other converging portion 3162 may permit the shaving aid to be passed on to the divergence point 3164. Once delivered to the divergence point 3164, the shaving aid may be discharged from all of the discharge portions 314.

Figure 9:
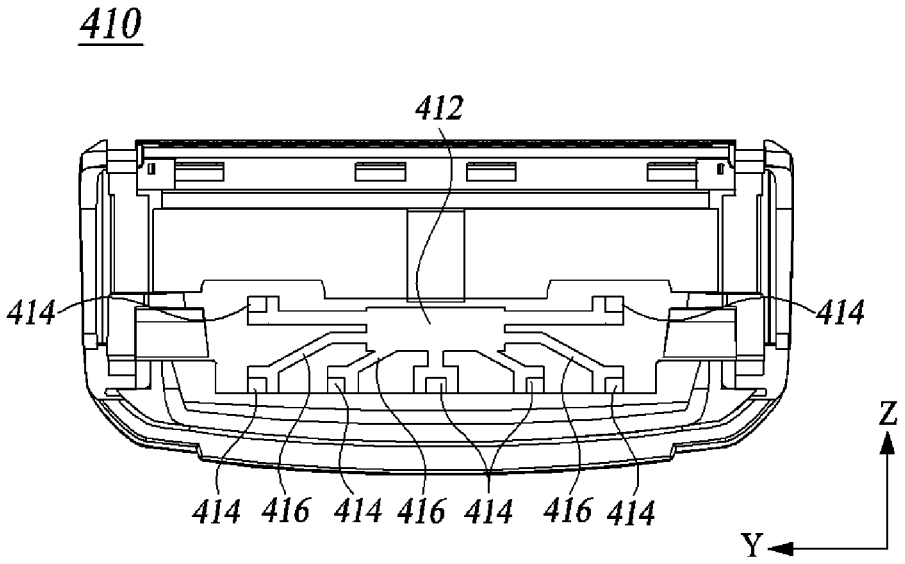
FIG. 9 is a rear view of a blade housing according to a fourth embodiment of the present disclosure.

FIG. 9 is a rear view of a blade housing 410 according to a fourth embodiment of the present disclosure.

As shown in FIG. 9, the blade housing 410 may include a single inlet portion 412 and a plurality of discharge portions 414.

The shaving aid introduced into the single inlet portion 412 may be delivered to the respective discharge portions 414 through a plurality of communicating portions 416 diverging from the inlet portion 412.

The razor assembly according to the fourth embodiment of the present disclosure uses the single inlet portion 412 and a plurality of discharge portions 414 in configuring the aid transfer passage to further simplify the shape of the aid delivery channel.

With the razor assembly according to the fourth embodiment of the present disclosure, the discharge portions 414 may be arranged with more freedom of design choice, enabling multiple discharge portions 414 to be distributed over the blade housing 410 for discharging the shaving aid over a wider area.

Figure 10:
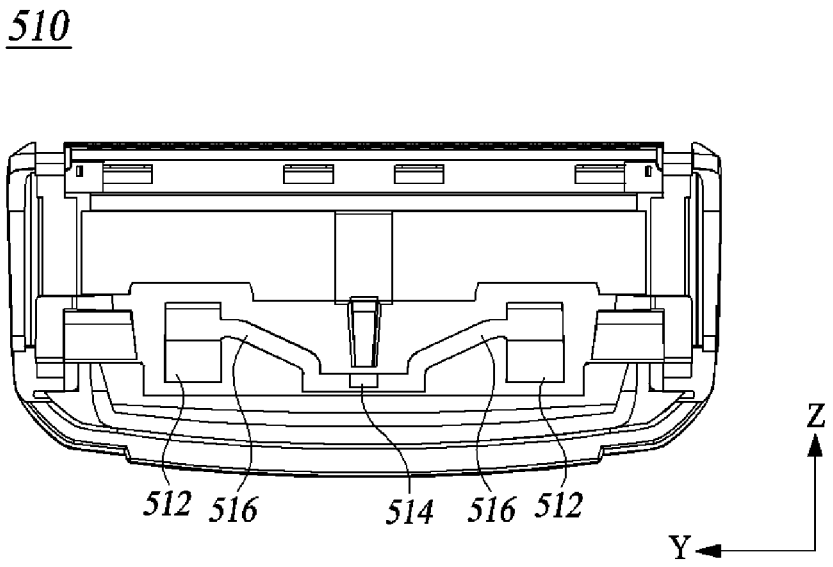
FIG. 10 is a rear view of a blade housing according to a fifth embodiment of the present disclosure.

FIG. 10 is a rear view of a blade housing 510 according to a fifth embodiment of the present disclosure.

As shown in FIG. 10, the blade housing 510 may include a plurality of inlet portions 512 and a single discharge portion 514.

The shaving aid introduced into the plurality of inlet portions 512 may converge to one discharge portion 514 through a plurality of communicating portions 516.

The razor assembly according to the fifth embodiment of the present disclosure uses a plurality of inlet portions 512 and one discharge portion 514 to make up the aid transfer passage, and thereby further simplifying the shape of the aid transfer passage.

In addition, the razor assembly according to the fifth embodiment of the present disclosure is configured to deliver the shaving aid from a plurality of inlet portions 512 to one discharge portion 514, thereby discharging relatively large amounts of shaving aid intensively to a specific position of the razor cartridge.

In addition, the razor assembly according to the fifth embodiment of the present disclosure may have a shape in which the discharge portion 514 is elongated in the longitudiunal direction. In this case, the shaving aid may be evenly discharged from the discharge portion 514 over a wider area.

Figure 11:
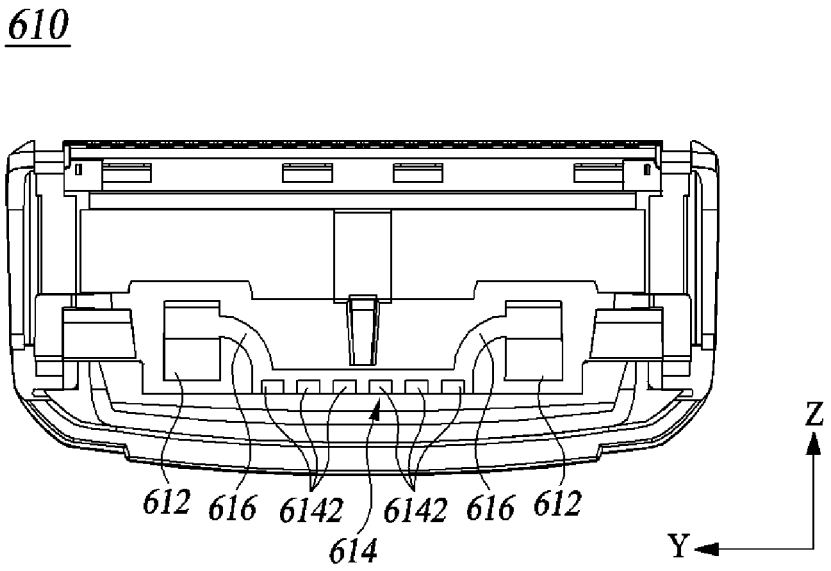
FIG. 11 is a rear view of a blade housing according to a sixth embodiment of the present disclosure.

FIG. 11 is a rear view of a blade housing 610 according to a sixth embodiment of the present disclosure.

As shown in FIG. 11, the blade housing 610 may include a plurality of inlet portions 612 and a single discharge portion 614. In addition, the single discharge portion 614 may include a plurality of discharge openings 6142.

In FIG. 11, the blade housing 610 is illustrated as having the single discharge portion 614, but the present disclosure is not limited thereto.

For example, the blade housing 610 may be provided with multiples of the discharge portion 614, and each of the discharge portions 614 may include a plurality of discharge openings 6142.

The plurality of discharge openings 6142 may be disposed on the discharge portion 614 to be spaced apart from each other along the longitudinal direction. However, the present disclosure is not limited to this configuration. For example, the plurality of discharge openings 6142 may be disposed on the discharge portion 614, spaced apart in the transverse direction, or sporadically disposed over a specific area.

The shaving aid delivered from the inlet portions 612 may be delivered to the single discharge portion 614 after passing through communication portions 616 which are formed on the blade housing 610.

The shaving aid delivered to the single discharge portion 614 may be discharged from the razor cartridge through the plurality of discharge openings 6142, simultaneously and over a large area.

On the other hand, when compared to the case where the discharge portion 614 has a single opening, the amount of shaving aid discharged from each of the discharge openings 6142 may be less.

Accordingly, the razor assembly according to the sixth embodiment of the present disclosure is configured to provide the single discharge portion 614 with a plurality of discharge openings 6142 so that the same amount of shaving aid is applied thinly over a larger area.

The second to sixth embodiments of the present disclosure shown in FIGS. 7 to 11 are merely some of the various embodiments of the present disclosure. Accordingly, the razor assembly according to the present disclosure may have other various embodiments than the above-described embodiments.

As described above, the razor assembly according to some embodiments of the present disclosure provides design freedom for allowing the inlet portion for letting in the shaving aid and the discharge portion for discharging the shaving aid to be repositioned to effect more efficient shaving routine.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor assembly, comprising:

at least one shaving blade having a cutting edge;

a blade housing configured to accommodate the at least one shaving blade such that a length direction of the blade housing is in parallel with a longitudinal direction of the cutting edge, wherein the blade housing comprises an inlet portion disposed on a rear surface of the blade housing, a discharge portion, and a communication portion configured to communicate with the inlet portion and with the discharge portion; and an aid supplying member configured to deliver a shaving aid to the inlet portion, wherein:

the shaving aid, which is delivered from the aid supplying member to the inlet portion, passes through the communication portion and is discharged from the discharge portion;

the communication portion has a recessed shape on the rear surface of the blade housing; and the rear surface of the blade housing is a surface disposed on an opposite side of the blade housing in a thickness direction with respect to a front surface adjacent to the cutting edge.

2. The razor assembly of claim 1, wherein the discharge portion is disposed spaced apart from the inlet portion.

3. The razor assembly of claim 2, wherein the discharge portion is disposed spaced apart from the inlet portion in the longitudinal direction of the cutting edge.

4. The razor assembly of claim 1, wherein the discharge portion is disposed in front of the at least one shaving blade.

5. The razor assembly of claim 1, wherein at least a portion of the discharge portion overlaps with an area of the blade housing, in which the at least one shaving blade is disposed.

6. The razor assembly of claim 1, wherein:

the discharge portion comprises a plurality of discharge portions; and the communication portion comprises a divergence point and a plurality of diverging portions that diverge from the divergence point such that each of the plurality of diverging portions is in communication with a respectively corresponding one of the plurality of discharge portions.

7. The razor assembly of claim 1, further comprising:

a cover member configured to cover at least a portion of the rear surface of the blade housing, wherein:

at least one of the communication portion or the discharge portion is shaped to have one open surface on the rear surface of the blade housing; and the one open surface of the at least one of the communication portion or the discharge portion is closed by the cover member.

8. The razor assembly of claim 7, wherein the cover member is detachably coupled to the blade housing.

9. The razor assembly of claim 1, further comprising a razor handle, wherein:

the aid supplying member includes a discharge end configured to discharge the shaving aid from the aid supplying member;

the blade housing is configured to be pivotable with respect to the razor handle about a rotation axis parallel to the longitudinal direction; and the discharge end does not interfere with the inlet portion when the blade housing pivots about the rotation axis.

10. The razor assembly of claim 9, wherein the rotation axis extends penetrating through the discharge end when the blade housing pivots about the rotation axis.

11. A razor cartridge, comprising:

at least one shaving blade having a cutting edge; and a blade housing configured to accommodate the at least one shaving blade such that a direction of the blade housing is in parallel with a longitudinal direction of the cutting edge, wherein the blade housing comprises an inlet portion disposed on a rear surface of the blade housing, a discharge portion, and a communication portion configured to communicate with the inlet portion and with the discharge portion, wherein the inlet portion is configured to receive a shaving aid such that the received shaving aid passes through the communication portion and is discharged from the discharge portion, wherein the communication portion has a recessed shape on the rear surface of the blade housing, and wherein the rear surface of the blade housing is a surface disposed on an opposite side of the blade housing in a thickness direction with respect to a front surface adjacent to the cutting edge.

* * * * *